US005419004A

United States Patent [19]

Fox

[11] Patent Number: 5,419,004

[45] Date of Patent: May 30, 1995

[54] TOTALLY ENCLOSED GAME CARD SCRAPER

[76] Inventor: Gary Fox, 215 Wildcat Dr., Winona, Tex. 75792

[21] Appl. No.: 167,480

[22] Filed: Dec. 15, 1993

[51] Int. Cl.[6] ..... A47L 13/08

[52] U.S. Cl. ..... 15/236.01; 15/104.8; 30/169

[58] Field of Search ..... 15/236.01, 236.05, 236.06, 15/236.07, 236.08, 236.09, 104.8; 30/136.5, 169, 280, 275, 272.1

[56] References Cited

U.S. PATENT DOCUMENTS 1,385,294 7/1921 Zorn ..... 30/136.5
4,115,892 9/1978 Stickler ..... 15/236.05
4,646,382 3/1987 Smith ..... 30/169
4,654,923 4/1987 Faciane et al. ..... 15/236 R
4,793,061 12/1988 Rizzo, Jr. ..... 30/169
4,881,291 11/1989 Ellis ..... 15/236.01
5,127,720 7/1992 Shultz ..... 312/229

*Primary Examiner*—David A. Scherbel
*Assistant Examiner*—Gary K. Graham
*Attorney, Agent, or Firm*—Charles W. Alworth; Ronald B. Sefrna

[57] ABSTRACT

A totally enclosed lottery or game card scraper box is disclosed. The box is designed as a simple two-handed portable device which scrapes the opaque covering from game or lottery cards and stores the scrapings within the box. The box seals itself and can be carried on a person without spilling its contents. A second feature offered by the box protects the game or lottery card surface frown inadvertent damage whilst scrapping the opaque covering from the surface of the card.

18 Claims, 11 Drawing Sheets

TOTALLY ENCLOSED GAME CARD SCRAPER

TECHNICAL FIELD OF THE INVENTION

The present invention relates to gaming apparatus and more specifically relates to an apparatus for easily and safely removing the opaque covering on state lottery tickets or other similarly coated game cards while protecting the environment by storing the removed covering within the device.

BACKGROUND OF THE INVENTION

Within the past few years many states within the Union have turned to state lotteries in order to raise needed operating monies. In line with the same trend, many merchants have also started similar games in which the customer scrapes a card to reveal a prize such as a free hamburger or a coupon good for a reduced price item. The drawback with these simple game cards is the mess caused by scraping the opaque covering from the card. Generally the opaque covering is scraped off by a coin, a fingernail, or any convenient scraping device. The removed scrapings, can and will fall onto the customer's clothing, the retail counter where the ticket is sold, or any place where the customer decides to scrape the card. The scraping material will melt and stain clothing, counter tops, car seats, etc. In the case where the customer uses the fingernail the covering material is caught under the fingernail and will be transferred to anything the customer touches. In other words the environment suffers whenever the game card is played.

Another problem suffered while using these games cards is inadvertent destruction of the printed numbers or symbols, hidden under the opaque covering, when the customer scrapes the covering away. It is known that these cards cause great excitement in the customer, which is one reason why they sell so well, and the customer can obliterate the hidden message. If the message is obliterated, the state or merchant cannot or will not pay as they cannot identify the winning number or symbols.

The first object of the invention is to provide a simple storage means for the removed scrapings so that they can be properly disposed of and will not harm the environment. The second object of this invention is to provide a simple device which will safely scrape off the opaque covering, assuring that the game card will not be damaged. That is, printed numbers or symbols appearing on the card will not be obliterated by the scrapping process.

PRIOR ART

A machine to safely scrape a game card, or to safely scrape such a card and store the opaque scrapings of game cards, is not new in the art. Examples of such art can be found in U.S. Pat. Nos. 4,646,382; 4,654,923; 4,793,061; 4,881,291; and 5,127,720. Three of these patents disclose devices that only scrape a game card and two of these patents disclose a device that both scrapes and stores the scrapings. The former devices will be the first to be discussed.

U.S. Pat. No. 4,646,382 (Smith) discloses an open, yet protected, spring loaded scraper blade formed of metal. The user should place the device over the game card and squeeze the device onto the card while holding one end of the card firmly in the other hand. The user should then draw both hands apart. This action causes the blade to drag across the card and scrape the opaque coating from the card's face. This device suffers from two disadvantages:

1) it does not store the scrapings, thus the scraping will still litter the environment: and,
2) it provides no protection to the printed face of the card by limiting the amount of squeezing force applied. Thus the numerals or the symbols can still be obliterated and the card could be torn.

U.S. Pat. No. 4,793,061 (Rizzo) attempts to resolve some of the limitations of Smith. Rizzo uses a fixed scraper blade within a molded plastic housing. The user is required to insert the game card into a slot, hold the device in one hand, and draw the card out of the other side of the device. The card slides under the scraper blade and is held against the blade by a fixed hump. Thus, the tendency to destroy the printed image on the card is reduced but not totally eliminated for a thicker than normal card. The device makes no attempt to store the scrapings. This device is cumbersome to use in that the game player must change hands after inserting the card and before pulling the card out of the device.

U.S. Pat. No. 4,654,923 (Faciane et al) is a totally new concept in that the scraper device stores a scraper blade within its body and is designed to clamp around the card to be scraped. The user removes the scraper blade and positions the card (or a roll of cards) inside the device. The device then provides a guide to run the scraper blade within. The device still has the same failings of the Smith disclosure, namely, no scraping storage and no obliteration protection. This device is cumbersome to use, in that the device must be positioned on the card, and the device must be placed on a flat stable surface in order to operate.

U.S. Pat. No. 4,881,291 (Ellis) is tile first device that attempts to store the scraping when it is used on a game card. The device is designed to be "passed" over the face of a game card held in place on a solid level plane surface, such as a counter top. The device has a scraper blade ill its nose and as the blade is pushed across the surface of the card, the scrapings are guided into and through a slot located immediately behind the blade. The scrapings then fall into a storage drawer located within the scraper blade housing. The object of the invention, to store scrapings, is obtained by the pushing and scraping action of the user gathering the scrapings up a chute and into the storage box. The device acts somewhat like a curved snow plow and like a curved snow plow, some of the scrapings will go to either side of the opening. Thus the device is not 100 per cent effective in gathering and storing scrapings. The device offers no protection for the over zealous game player ill that the printed surface can still be obliterated. This apparatus, like Faciane et. al, needs a flat, stable surface on which to operate. This means that it cannot be hand held or used in any situation.

U.S. Pat. No. 5,127,720 (Shultz) is designed to collect 100 per cent of the scrapings of any game card on which it is used. The device is almost a step backward because the scraping device is a circular piece of metal of the size of a quarter. Quarter coins are among the most popular scraping devices used by the game player! Furthermore, the apparatus is not meant to fit in one's pocket, but is designed to be placed in a permanent location. To use the device, the card is placed inside the device and held by the finger(s) of one hand while the other hand uses the circular metal device to scrape the card. The scrapings remain within the confines of the device and are swept into a slot within the device where they then fall into a storage drawer. The device stores the scrapings but it requires a conscious act on the part of the user to move those scrapings to a point where they drop into a storage compartment. If tile user forgets to move the scrapings, they will fall out. Finally, the device provides no protection for the over zealous scraper and the printed surface call still be obliterated.

SUMMARY OF THE INVENTION

The instant invention solves all tile problems posed by the prior art by providing a self sealing, self adjusting, pocket or handbag portable game card scraping apparatus which will store all scrapings and reduce chances of obliteration or tearing of the printed game card. The totally enclosed game card scraper consists of an oblong box which is slightly larger than the width and length of a game card. Its thickness is considerably larger than a game card in that the scrapings are stored within tile box; however, the thickness will be on tile order of one-half inch. Its width and length dimensions exceed that of the game card by the thickness of tile plastic used to manufacture tile box and the necessary direction spacers to direct tile game card into and out of tile entry slot in the box. The box contains an internal scraper to remove tile opaque material. The scraper also serves to seal the entry slot of the box when tile box is not in use. On tile top of the box there is a small sliding button ergonomically designed to fit the thumb or finger of a hand.

To use the device, tile game player holds tile box in one hand and uses the thumb or finger of that hand to slide the button backward away from the entry slot. This allows tile scraper blade to move upward within the box, opening tile entry way. The user then slides the game card into the entryway. The user then pushes the button down, putting a controlled force on the scraper blade which tends to push it down against the card. The user now withdraws the card from the box. As the user withdraws the card, the scraper blade glides along the surface of the card, removing the opaque covering from that surface. As the card exits the entryway, the spring loaded scraper blade holds all the scrapings within the box. The user then pushes the button forward which causes the blade to drop fully down to seal the entryway. This final action by the blade assures that all scraping will remain within the box. The sealed box can now be stored in the pocket or handbag of the user without dumping any of tile scrapings.

The spring constant of the spring loaded scraper blade is chosen so that when the control button is pushed forward, the proper scraping force is applied against the face of the card. This reduces the chances of obliteration of the printed symbols under the opaque surface to a minimum. Thus the excited game player can rarely if ever damage the game card by over zealous actions. The box can easily be emptied by opening a door in the box in the end opposite the entryway and dumping the scrapings in a suitable disposal.

Thus the instant invention solves all tile problems remaining in the prior art. It places the proper force on the card so that the opaque material will be scraped off while minimizing the chances of obliteration of the printed symbols or tearing of the card. The device conveniently stores the scrapings so that the scrapings will not damage the environment. It provides a truly portable and easily operated game card scraper that requires no hand changing to operate. It can be portable and retained by the user; or it can be kept in a fixed location such as the retail point of sales or distribution of the game card.

DESCRIPTION OF THE PREFERRED EMBODIMENT

Figure 1:
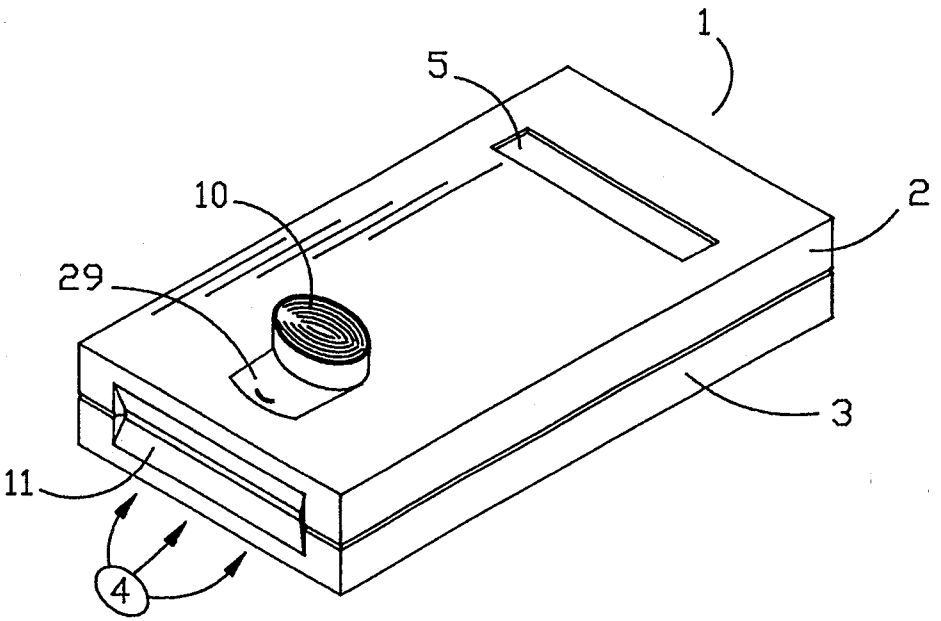
FIG. 1 is an isometric view of the instant invention viewed from the entryway.
Figure 2A:
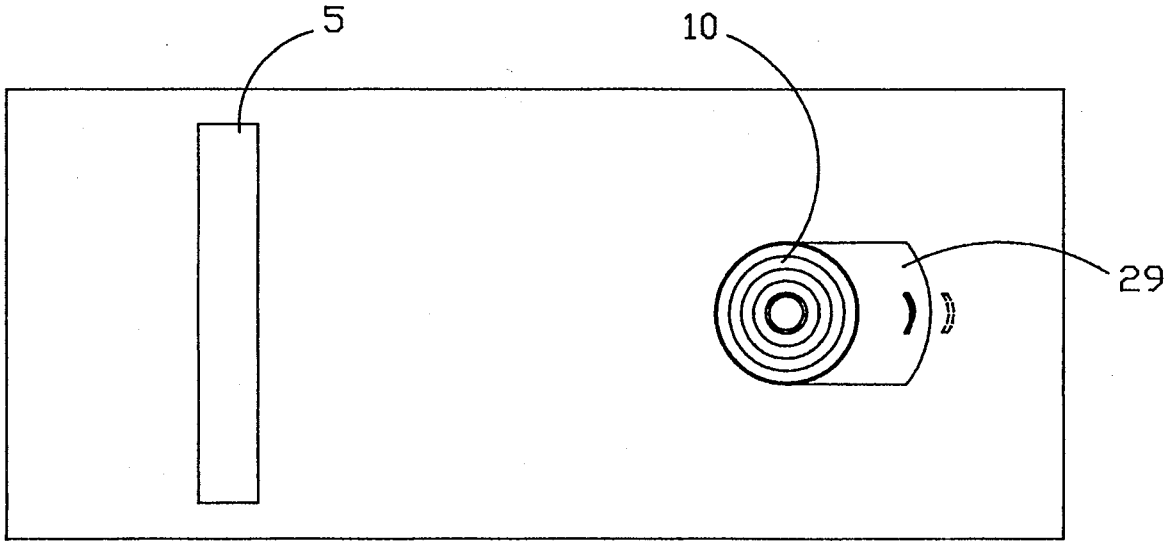
FIG. 2A is a plan view of the device.
Figure 2B:
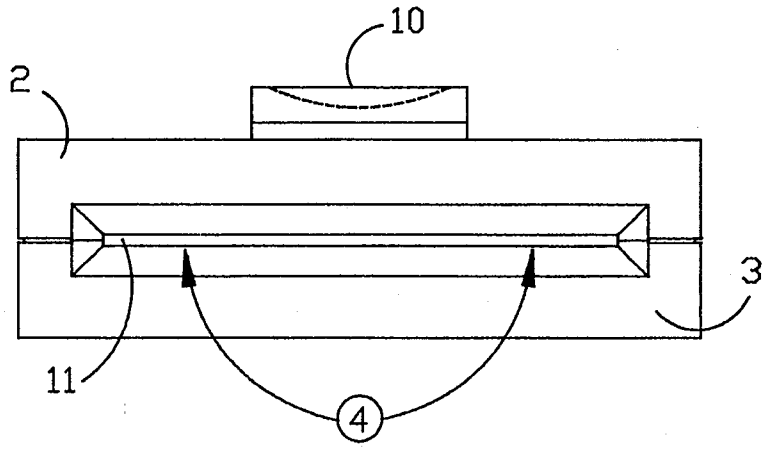
FIG. 2B is an end view of the device looking directly at the entryway.
Figure 2C:
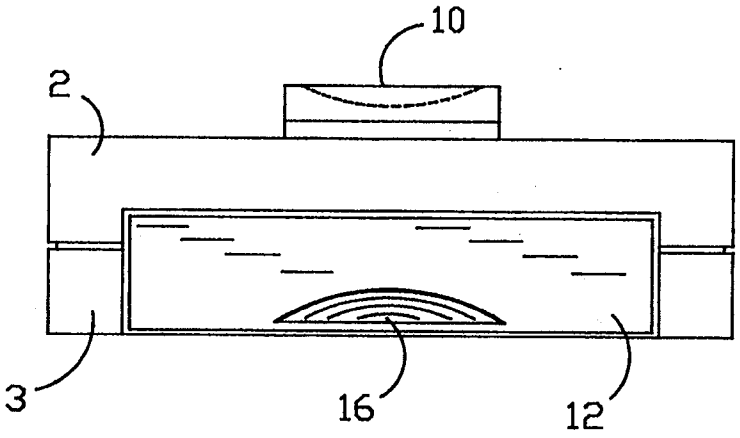
FIG. 2C is an end view of the device looking that the disposal door opposite the entryway.
Figure 2D:
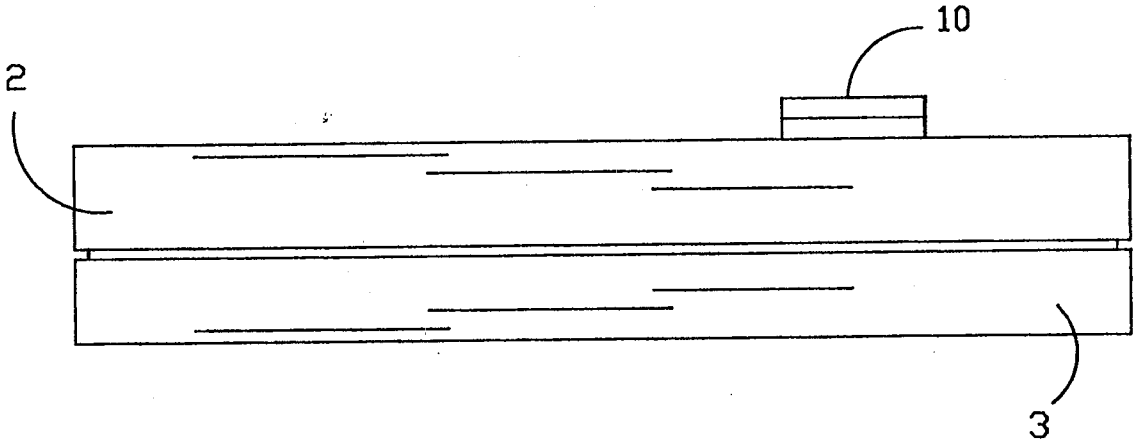
FIG. 2D is a side view of the device.

The preferred embodiment of the totally enclosed game card scraper, shown in FIG. 1 generally as (1), consists of a plastic oblong box which is slightly larger than the width and length of a game card. Its thickness is considerably larger than a game card in that the scrapings are stored within the box; however, the thickness will be on the order of one-half inch. Its width and length dimensions exceed that of the game card by the thickness of the plastic used to manufacture the box and the necessary guide spacers to guide the game card into and out of the entry slot in the box. The thickness is set by similar considerations as those setting the width and length, except that extra allowance must be made for the scraper blade and space for storing scrapings. To facilitate the manufacture of the device, it is made in two halves, the top half (2) which retains a scraper blade [shown in other Figures as (9)], a control button (10) and a control button slot (29); and the bottom half (3) which includes the waste door (12) molded as a part of the bottom half. The two halves join together to form an entryway (4) containing a slot (11) for the game card (6) shown in FIG. 4.

The top half (2) contains a blade slot (5). The blade slot is molded into the plastic at manufacture and actually is formed when the blade retainer bar (23) is formed. The relationship between the blade slot (5) and the blade retainer bar (23) is more clearly shown in FIG. 5A. The use and purpose of the blade retainer bar (23) will be explained shortly. The bottom half (3) has a molded live hinge (8) within the inside section. The live hinge (8) connects the waste door (12) to the bottom half (3). The position of the live hinge (8) and its relationship to the waste door (12) is clearly shown in FIGS. 3 and 4.

Figure 6C:
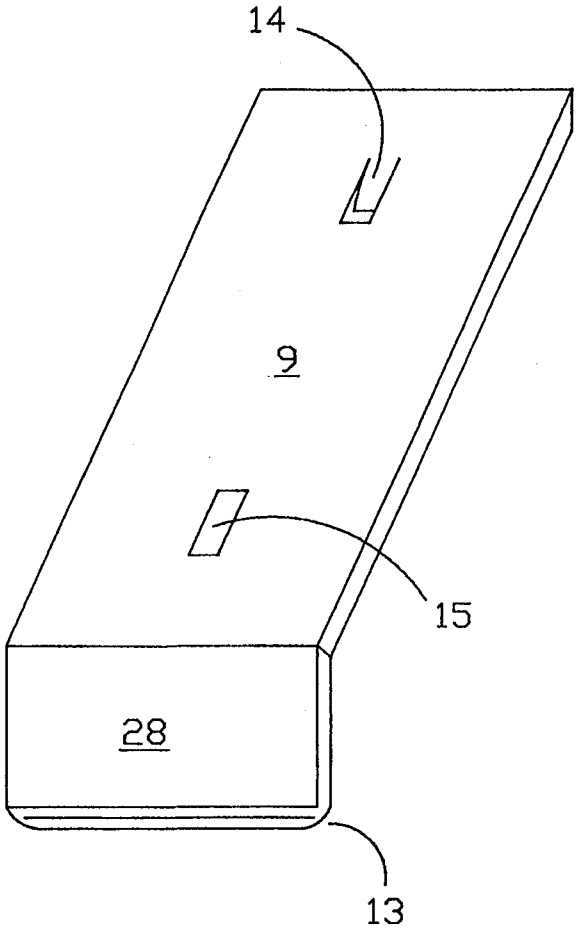
FIG. 6C is an isometric view of the scraper blade.
Figure 6B:
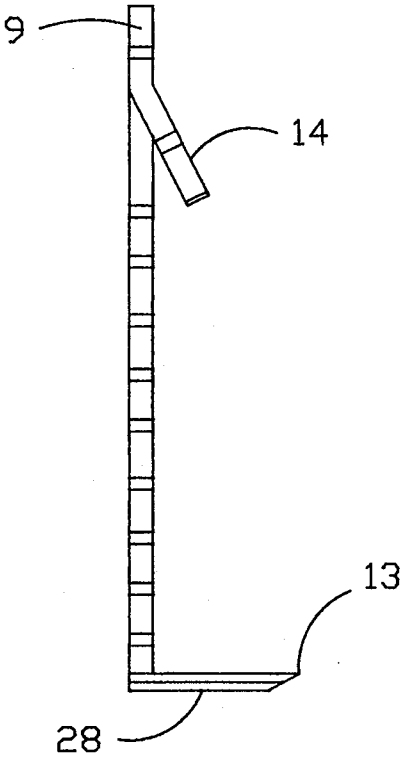
FIG. 6B is a side view of the scraper blade, taken along "B" of FIG. 6A.
Figure 6A:
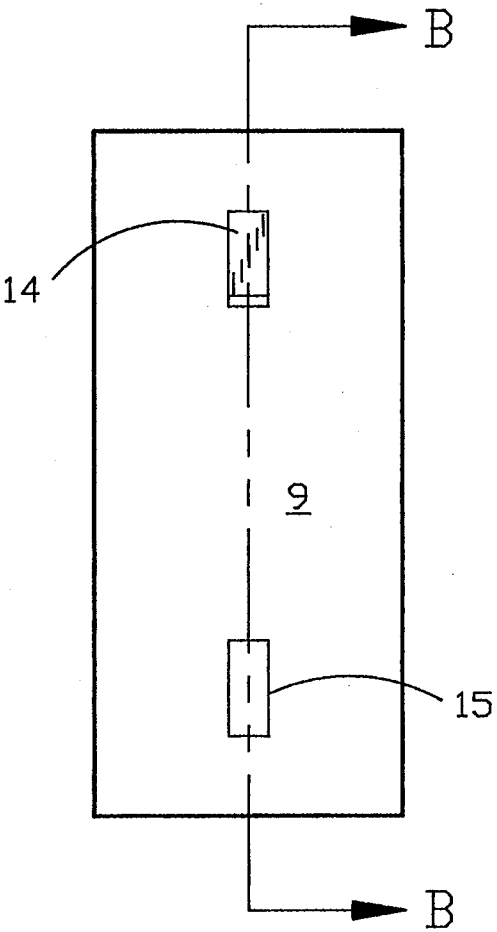
FIG. 6A is a plan view of tile scraper blade.

An isometric view of tile scraper blade, generally item (9), is shown in FIG. 6C. The blade can be made of metal or a hard plastic such as polycarbonate. Referring to FIGS. 6A and 6B, the blade has a bevel (13) which does tile actual scraping of the opaque surface. The blade has a first, main, portion and a second portion which extends from the main body of the blade and which is in a generally perpendicular relationship to the main body of tile blade. The blade bevel is formed from the section (28) of the blade offset from tile main body. The blade bevel can be formed into the blade front edge (28) or it could be a piece of metal placed into the blade front edge (28). The blade bevel is not necessary if the offset section (28) of the blade is made slightly more or less than 90 degrees. Preferably, when no blade bevel is used, the section angle should be slightly less than 90 degrees. It should be noted that tile edges of the blade are rounded so that the blade will not catch against tile corresponding edges of the game card and tear the surface from the card. The main body of tile blade has a slot (15) which receives the control button (10) and a blade tab (14) which interacts with the top half of the box to retain the blade within the box.

Figure 3:
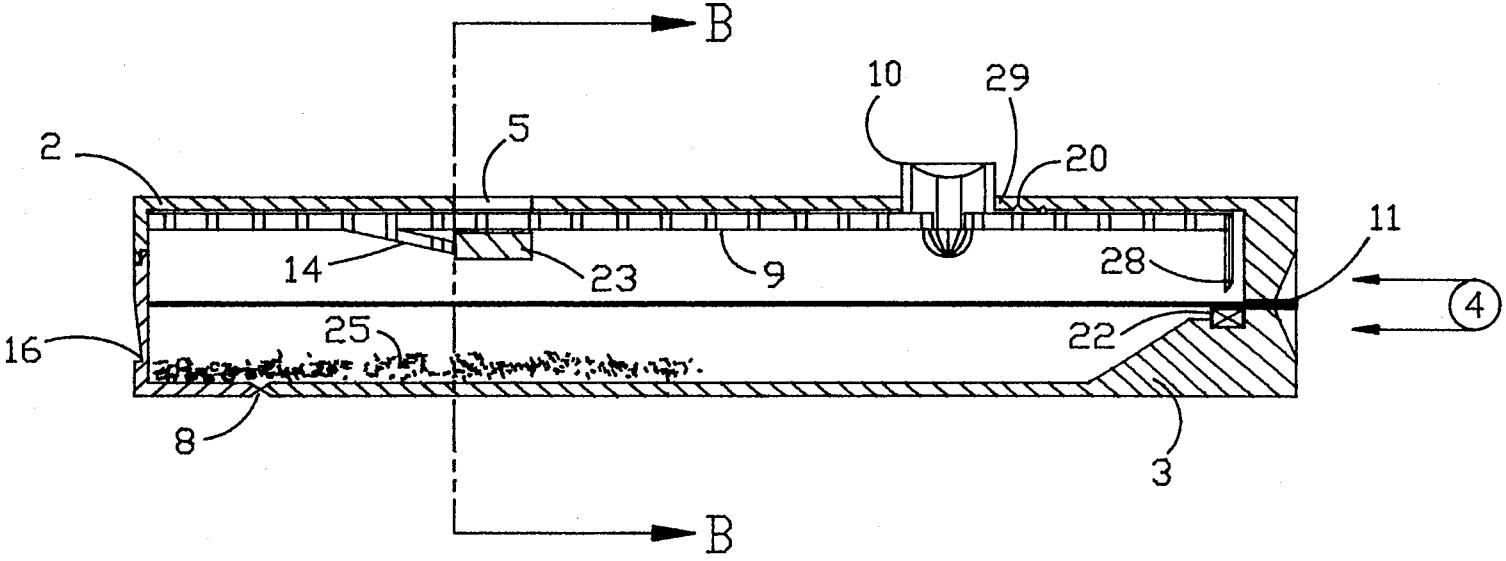
FIG. 3 is a cross-sectional view of the device showing the scraper blade in its scraping position and closing the entryway.
Figure 5C:
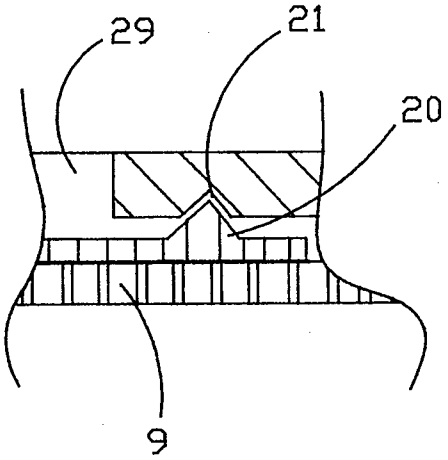
FIG. 5C shows the control button locking scheme.
Figure 5A:
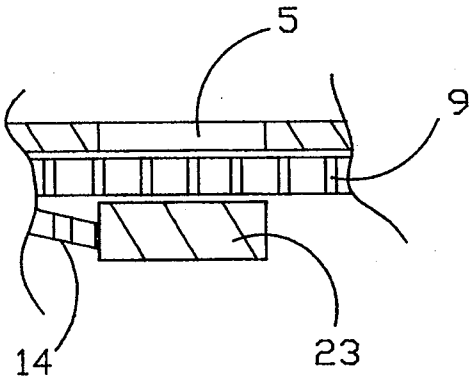
FIG. 5A is a detailed cross-sectional view of the blade slot, showing how the blade tab locks into the blade slot.
Figure 5D:
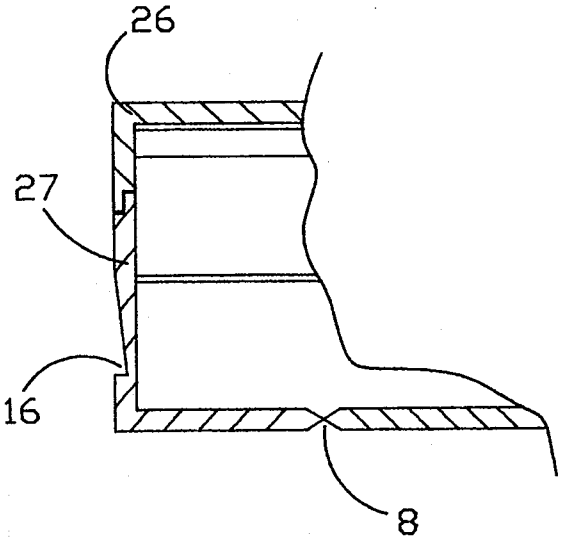
FIG. 5D shows the waste door friction catch.
Figure 5B:
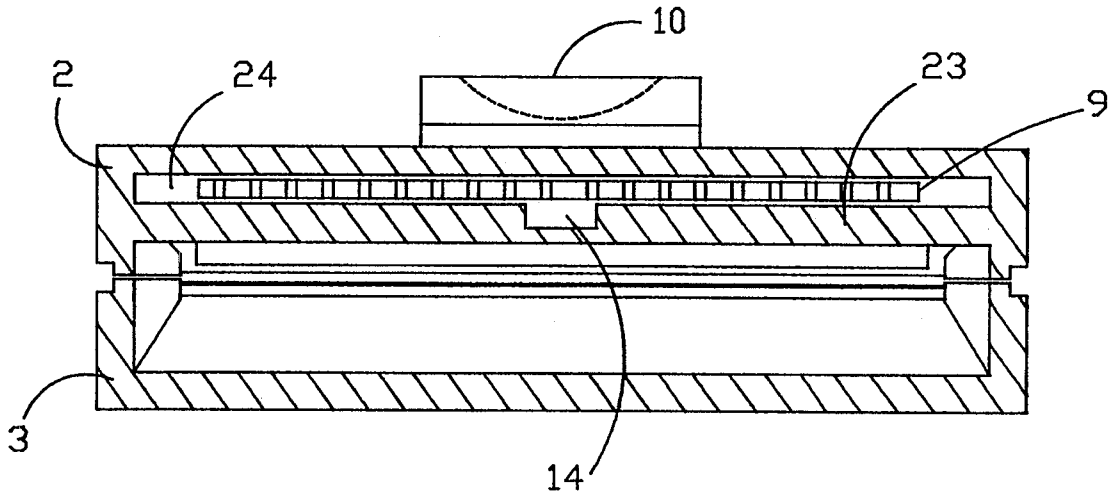
FIG. 5B is a cross-sectional view of the blade slot taken along "B" of FIG. 5A.

The interaction of the blade retainer tab (14) with the upper half (2) of the box is more clearly shown in FIG. 3, a cross-sectional view of the box. Expanded details are shown in FIG. 5A and FIG. 5B. The blade slides into the upper half (2) and through a blade slot (5). The blade slot acts to hold the blade (9) up against the inside of the upper half (2) of the box. The blade retainer tab (14) pops down behind the blade retainer bar (23) so that the blade cannot move forward. The far end of the blade (opposite the blade bevel) is held by the back of the box; thus, the blade is no longer free to move out of the box. The clearances between the sides of the box (24) and the blade are minimal so that the blade just squeezes into place and so that no scrapings can come out of the box. This clearance (24) is only important in the area of the blade slot (5) as this is the only area that scrapings might fall out. Before the blade is placed, the control button (10) is set into its position on the blade. The actual steps of construction serve to illustrate a series of possible manufacturing steps and are not intended to limit manufacture of the device.

Figure 7C:
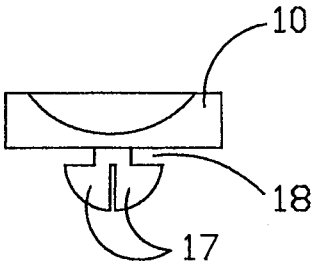
FIGS. 7A, 7B and 7C show details of the control button.
Figure 7B:
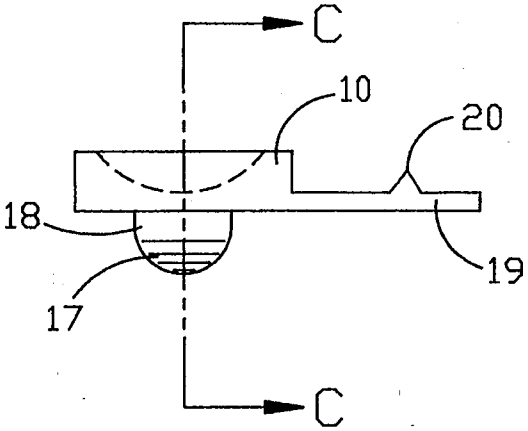
Figure 7A:
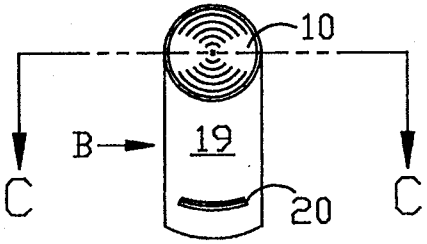

The control button (10) is shown in greater detail in FIGS. 7A, 7B and 7C. The control button (10) fits within the blade button slot (15) in the blade (9). The button (10) has two wing tabs (17) which insert into the blade button slot (15) and hold the button in place. The control button is now free to slide back and forth within the blade button slot on the grooves (18) within the bottom wings (17). The control button (10) also has a slider plate (19) and a retainer nipple (20) which is designed to interact with the retainer slot (21) in the upper half (2) of the box. The control button is free to move within the confines of the control button slot (29) in the box upper half (2). This interaction will be explained shortly.

The normal, or closed, configuration of the box is shown in FIG. 3. Here the blade front edge (28) is shown pressing against the bevel block (22). This means that the entry slot (11) is closed off and that nothing can enter, nor leave the box. The blade front edge is held in this position whenever the control button (10) is pushed forward toward the entryway (4). Note that when the control button is in its most forward position, the control button retainer nipple (20) catches within the retainer slot (21) molded into the box upper half (2). This interaction keeps the control button from inadvertently sliding backwards.

Figure 4:
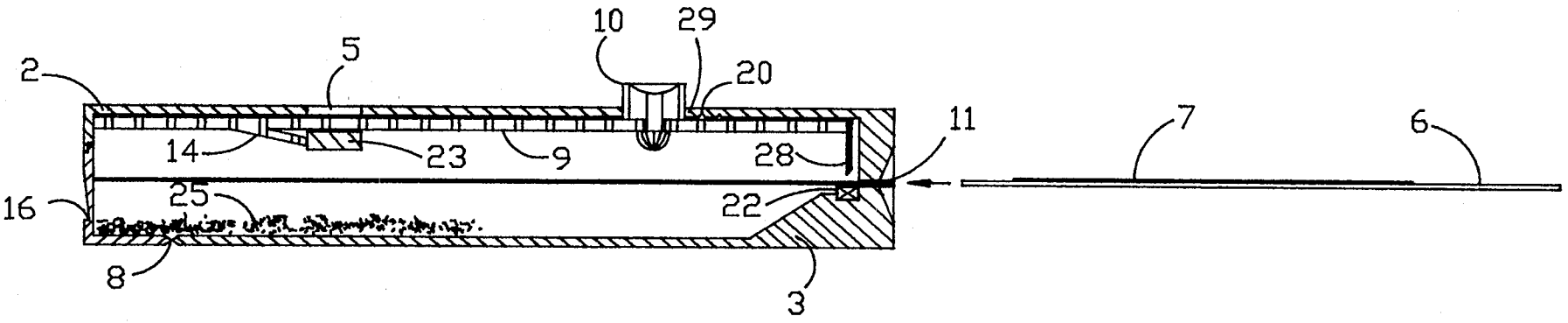
FIG. 4 is the same cross-sectional view of FIG. 5 showing the scraper blade in the open position so that a game card can be inserted into the entryway.

To use the scraper box, the game player holds the box in one hand and uses the fore finger or preferably the thumb to press down on the control button and slides it backward. These actions disengage the control button retainer nipple (20) from the retainer slot (21). As the control button (10) slides backward in the button slot (29) and as the control button ear (19) enters the button slot, the control button pops upward. The upward movement of the control button (10) within the button slot (29) allows the blade front edge (28) to expose the entry slot (11) in the entryway (4). This means that the inside of the box can be accessed as shown in FIG. 4.

The game player, using the free hand, now inserts the game card (6) through the entryway (4) and through the entry slot (11) until the card reaches the back of the box. The game player now presses down with the finger or thumb onto the control button (10). This action attempts to push the blade front edge (28) down, as though to close the entry slot (11), until it encounters the game card. There is enough resiliency in the blade between the blade button slot (15) and the blade front edge (28) to form a spring. Thus, the blade front edge (28) is spring loaded against the game card (6) and further against the bevel block (22). [It would be possible for the game player to slide the button forward until the retainer nipple (20) fits within the retainer slot (21) or until the button will no longer move forward in the button slot (29); thus spring loading the scraper blade against the card.]The game player now pulls the card out of the box and back through the entryway. As the card withdraws, the blade bevel drags against the opaque surface (7) on the card. This scrapes the opaque surface from the card and leaves the scrapings (8) within the box. As the card clears the box, the blade front edge (28) shuts against the bevel block (22) thus sealing the box and keeping the scrapings (8) within the box. To play another card, the user would release the button and insert the next game. These actions are repeated each time a game card is played. To seal the box, the user slides the button forward until the retainer nipple (20) fits within the retainer slot (21) or until the button will no longer move forward in the button slot (29); this action forces the blade against the bevel block (22) and tightly seals the box.

To empty a scraper box of retained scrapings, the user places the thumb or finger nail into the nail slot (16) of the waste door (12) and pulls downward. The door moves against the friction lips (27) and (26) and turns about the living hinge (25) to open. The user then empties the box in the proper place and closes the waste door, leaving the scraper box ready for continued use.

It should be apparent to any person skilled in the art that the blade front edge could be made flat with no blade bevel. The scraping edge could be moved down onto the bevel block (22) and the card inserted upside down into the box. The above scraping actions would occur on the sharp edge now contained within the bevel block. This modification or similar modifications are within the scope of this invention. Manufacturing of such a bevel block could be easier and a metal scraper blade could easily be inserted in the block. It is felt, however, that the chances of damage to the card are increased and the preferred embodiment will protect the card from damage in the best way possible.

I claim:

1. A totally enclosed game card scraper apparatus for removing an opaque covering material placed on a surface of game or lottery cards and retaining the scrapings removed covering material within the apparatus, said scraper apparatus comprising a hollow box having a top side, a bottom side, a front side wall, a rear side wall, a right side wall, and a left side wall, each of said top and bottom sides having an inner surface and an outer surface, and each of said front, rear, right, and left side walls having an inner surface and an outer surface, all of said surfaces together defining an interior and exterior of said box;

an entry slot formed in and extending through said front side wall, providing a passageway from the exterior of said box to the interior thereof;

scraper means disposed in the interior of said box to be selectively brought into contact with the surface of a game or lottery card disposed in said box for scraping the opaque covering material from said game or lottery card and directing said opaque covering material into the interior of said box as said card is removed from said box;

said scraper means further defining closure means for selectively closing said entry slot so as to prevent egress of scraped opaque covering material from the interior of said box through said entry slot; and door means for selectively opening a portion of said box for the purpose of removing scraped opaque covering material from the interior of said box.

2. The totally enclosed game card scraper apparatus of claim 1, wherein said box is longitudinally bifurcated along a bifurcation line into a top portion and a bottom portion, said top portion including said top side and portions of said front, rear, right, and left side walls, and said bottom portion including said bottom side and the remaining portions of said front, rear, right, and left side walls, with said bifurcation line extending through and dividing said ennui slot.

3. The totally enclosed game card scraper apparatus of claim 1, wherein said door means comprises a waste door formed in and pivotally interconnected to said box, opening a passageway from the interior of said box to the exterior of said box with said waste door in an open position and closing said passageway with said waste door in a closed position.

4. The totally enclosed game card scraper apparatus of claim 3, wherein said waste door includes a nail slot formed an the outer surface of said waste door to facilitate opening said waste door.

5. The totally enclosed game card scraper apparatus of claim 3, wherein the pivotal connection between said waste door and said box is formed as a live hinge formed in the material of construction of said box and said waste door.

6. The totally enclosed game card scraper apparatus of claim 1, wherein said box further includes a blade retainer bar extending across and interconnected within the interior of said box near said rear wall thereof between said right side wall and said left side wall and spaced a short distance from said inner surface of said top side so as to form a blade slot between said blade retainer bar and said inner surface of said top side, said blade retainer bar having an upper surface, a lower surface, and back edge, and a front edge;

a button slot extending through said top side of said box near said front side wall thereof and along said top side of said box between said right side wall and said left side wall;

a retainer slot extending into said top side of said box from the interior surface thereof, disposed adjacent to the end of said button slot nearest said front side wall; and a bevel block having an tipper surface, disposed in the interior of said box and extending upwardly from the inner surface of said bottom side with said upper surface of said bevel block parallel to and aligned with said entry slot.

7. The totally enclosed game card scraper apparatus of claim 6, wherein said scraper means comprises a blade assembly having an elongate blade with a back edge, a front edge, and side edges, with a first portion including the majority of the length of said blade from said back edge toward said front edge in a first plane and with a remaining, second portion of said blade to said front edge in a second plane generally perpendicular to said first plane, said front edge of said blade including a blade bevel, said blade extending through said blade slot and retained by said blade retainer bar in the interior of said box with said blade bevel disposed above said upper surface of said bevel block; and control means extending through said button slot and contacting said blade for the purpose of selectively forcing said blade toward said bottom side until said blade bevel contacts said bevel block.

8. The totally enclosed game card scraper apparatus of claim 7, wherein said blade further includes a blade button slot aligned with said button slot in said box with said blade disposed in said box, and wherein said control means comprises a control button assembly including a generally planar slide plate, having a first end, a second end, an upper surface, and a lower surface, to be disposed between said blade and the inner surface of said top side of said box, a button interconnected to and extending upward from said upper surface of said slide plate at said first end thereof through said button slot in said top side of said box, a control button retainer nipple interconnected to and extending upward from said upper surface of said slide plate near said second end thereof to be received in said retainer slot in said top side of said box, and control button wings interconnected to and extending downward from said lower surface of said slide plate at said first end thereof through said blade button slot in said blade, said control button wings having opposing grooves to slidably receive the edges of said blade button slot therein and slidably interconnect said control button wings and said blade, said control button assembly interacting with said blade assembly such that said blade bevel is forced downward against said bevel block in response to downward force imposed on said button, and such that said blade bevel is retained in contact with said blade bevel when said control button assembly is moved toward said front side wall of said box and said control button retainer nipple is received in said retainer slot.

9. The totally enclosed game card scraper apparatus of claim 8, wherein the width of said second portion of said blade is slightly smaller than the distance between said right side wall and said left side wall of said box immediately behind said entry slot, and wherein said closure means for selectively closing said entry slot is said second portion of said blade.

10. The totally enclosed game card scraper apparatus of claim 9, wherein said blade is constructed of a polycarbonate material.

11. The totally enclosed game card scraper apparatus of claim 9, wherein said blade is constructed of spring steel.

12. The totally enclosed game card scraper apparatus of claim 9, wherein said blade is constructed of a plastic material and wherein said blade bevel is constructed of metal and interconnected to said front edge of said blade.

13. The totally enclosed game card scraper apparatus of claim 9, wherein said blade block is a scraper blade.

14. A totally enclosed game card scraper apparatus for removing an opaque covering material placed on a surface of game or lottery cards and retaining the removed covering material within the apparatus, said scraper apparatus comprising a hollow substantially rectangular box, including an elongated top side, and an elongated bottom side, each having an inner surface and an outer surface, a front side wall, a rear side wall, a right side wall, and a left side wall, each having an inner surface and an outer surface, said box being longitudinally bifurcated along a plane extending between said top side and said bottom side so as to form a top portion containing said top side and top sections of said front side wall, said rear side wall, said right side wall, and said left side wall, and a bottom portion containing said bottom side and bottom sections of said front side wall, said rear side wall, said right side wall, and said left side wall, all of said surfaces together defining an interior and exterior of said box;

an entry slot extending through said front side wall to form a passageway from the exterior of said box to the hollow interior thereof to receive a game card, said entry slot being substantially parallel to the line of bifurcation of said box and having an upper edge and a lower edge;

blade retainer means for retaining a scraper blade in said top portion of said box;

an elongated button slot extending through said top side near said front side wall, with the longitudinal axis of said button slot aligned with the longitudinal axis of said top side;

a retainer slot extending into said top side of said box from the inner surface thereof, disposed near said button slot between said button slot and said top portion of said front side wall;

a bevel block disposed in said bottom portion of said box and interconnected thereto adjacent to said bottom portion of said front side wall, said bevel block having an upper surface aligned with said lower edge of said entry slot and extending between said bottom portions of said right and left side walls through the length of said entry slot; and a waste door formed in said bottom portion of said box, including a portion of said bottom side and a portion of said bottom portion of said rear wall, said waste door pivotally connected to said bottom portion of said box so as to prevent egress of covering material from said box through said waste door with said waste door in a closed position and to allow removal of covering material from said box through said waste door with said waste door in an open position; a blade assembly including an elongate blade with a back edge, a front edge, and side edges, having a first portion including the majority of the length of said blade from said back edge toward said front edge and having a second portion including the remainder of the length of said blade to said front edge, with said second portion extending from said first portion in generally perpendicular relation thereto, said front edge of said blade including a blade bevel, said blade retained in the top portion of said box with said first portion of said blade generally parallel to said top side of said box and with said second portion of said blade extending toward said bottom portion of said box with said blade bevel disposed above said upper surface of said bevel block; and a blade button slot extending through said first portion of said blade in coaxial relation therewith, said blade button slot symmetrically disposed between said side edges of said blade and aligned with said button slot in said top side of said box; a control button assembly including a generally planar slide plate, having a first end, a second end, an upper surface, and a lower surface, to be disposed between said blade and the inner surface of said top side of said box:

a button interconnected to and extending upward from said upper surface of said slide plate at said first end thereof through said button slot in said top side of said box;

a control button retainer nipple interconnected to and extending upward from said upper surface of said slide plate near said second end thereof to be received in said retainer slot in said top side of said box; and control button wings interconnected to and extending downward from said lower surface of said slide plate at said first end thereof through said blade button slot in said blade, said control button wings having opposing grooves to slidably receive the edges of said blade button slot therein and slidably interconnect said control button wings and said blade, said control button assembly interacting with said blade assembly such that said blade bevel is forced downward against said bevel block in response to downward force imposed on said button, and such that said blade bevel is retained in contact with said blade bevel when said control button assembly is moved toward said front side wall of said box and said control button retainer nipple is received in said retainer slot; and said blade assembly further defining closure means for selectively closing said entry slot against the egress of covering material from the interior of said box through said entry slot.

15. The totally enclosed game card scraper apparatus of claim 14, wherein said blade retainer means of said box comprises a blade retainer bar disposed in said top portion of said box and interconnected thereto, said blade retainer bar extending between said top portions of said right and left side walls near said rear side wall and spaced a short distance from the inner surface of said top side, forming a blade slot between said blade retainer bar and the inner surface of said told side to receive said first portion of said blade therethrough.

16. The totally enclosed game card scraper apparatus of claim 15, wherein said blade assembly further includes a blade tab extending outward from said first portion of said blade toward said bottom side of said box with said blade retained in said top portion of said box, said blade tab to be received behind and against said blade retainer bar so as to prevent the removal of said blade frown said blade slot.

17. The totally enclosed game card scraper apparatus of claim 14, wherein said closure means for selectively closing said entry slot comprises said second portion of said blade.

18. The totally enclosed game card scraper apparatus of claim 14, wherein said waste door is integrally formed with said bottom portion of said box, wherein the material of construction is a plastic material, and wherein said pivotal connection between said waste door and said bottom portion of said box is formed as a living hinge.

* * * * *